US011324321B2

(12) United States Patent
Yao et al.

(10) Patent No.: US 11,324,321 B2
(45) Date of Patent: May 10, 2022

(54) READY TO ASSEMBLE SEATING

(71) Applicants: Zheng Yao, Hudson (CA); Douglas Tripp, Mattawan, MI (US)

(72) Inventors: Zheng Yao, Hudson (CA); Douglas Tripp, Mattawan, MI (US)

( * ) Notice: Subject to any disclaimer, the term of this patent is extended or adjusted under 35 U.S.C. 154(b) by 0 days.

(21) Appl. No.: 17/128,088

(22) Filed: Dec. 19, 2020

(65) Prior Publication Data

US 2021/0361071 A1 Nov. 25, 2021

Related U.S. Application Data

(63) Continuation of application No. 16/238,224, filed on Jan. 2, 2019, now Pat. No. 10,897,996.

(60) Provisional application No. 62/613,033, filed on Jan. 2, 2018.

(51) Int. Cl.
*A47C 4/02* (2006.01)
*A47C 7/62* (2006.01)

(52) U.S. Cl.
CPC ..... *A47C 4/028* (2013.01); *A47C 7/626* (2018.08)

(58) Field of Classification Search
CPC ..... A47C 4/028; A47C 7/626
See application file for complete search history.

(56) References Cited

U.S. PATENT DOCUMENTS 3,669,495 A * 6/1972 Von Rudgisch ..... A47C 4/028 297/451.11
2017/0071354 A1* 3/2017 Mezzera ..... A47C 4/028

* cited by examiner

*Primary Examiner* — Anthony D Barfield

(57) ABSTRACT

Embodiments of the invention may include a ready-to-assemble chair, comprising a seat assembly, wherein said seat assembly comprises a top seat surface, at least three sides, and an underside, wherein the underside has an internal cavity defined by the at least three sides; a seat back assembly, wherein said seat back assembly is configured to fit substantially within the internal cavity of the underside of the seat assembly in a flat orientation when said chair is disassembled; and at least three legs. Some aspects of the present invention may include a method of assembly of a ready-to-assemble chair, as well as methods of packaging the same.

14 Claims, 9 Drawing Sheets

Fig. 1
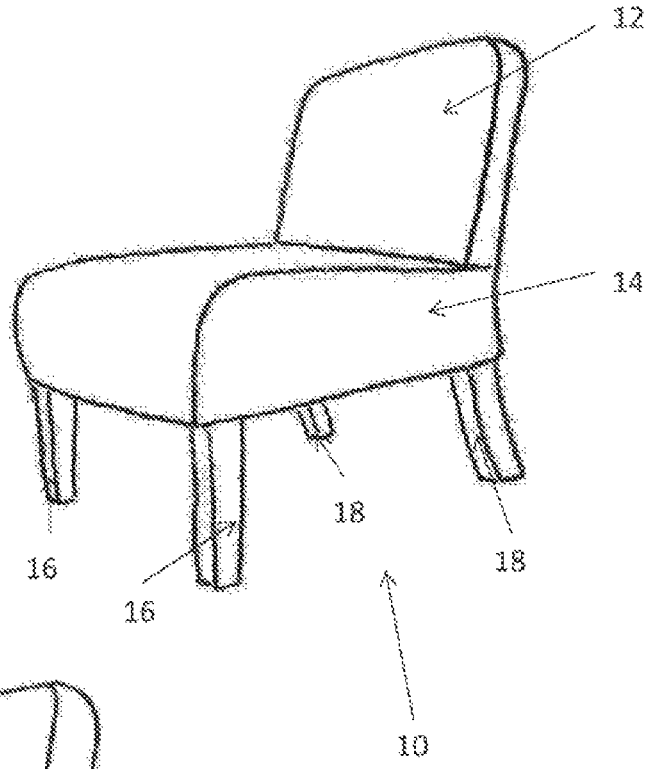
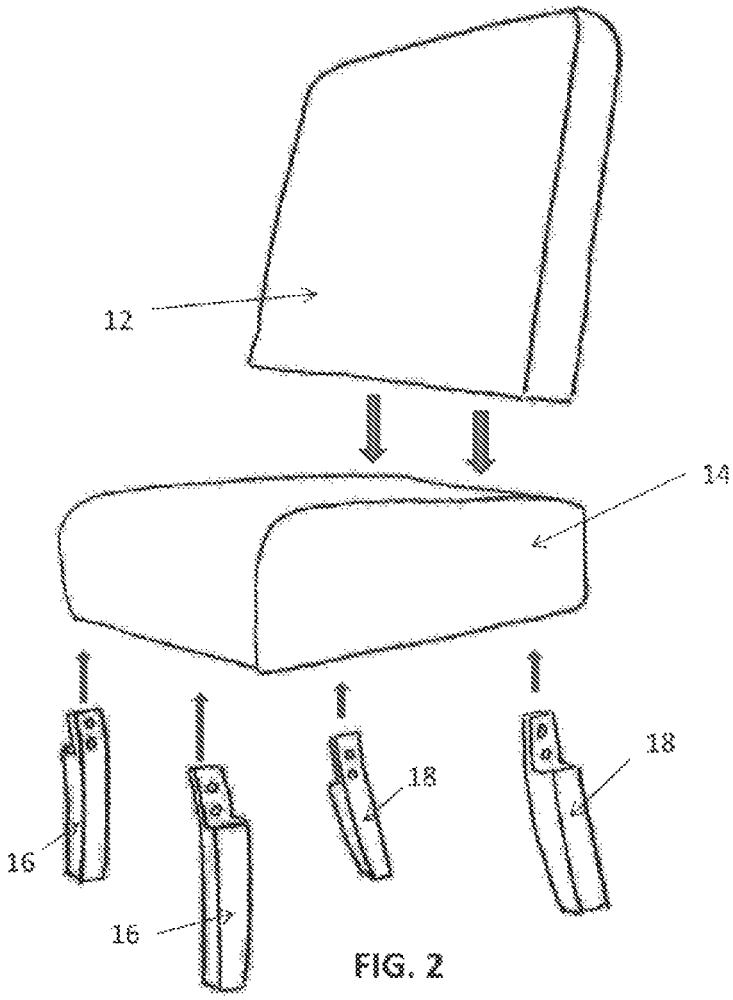
FIG. 2

READY TO ASSEMBLE SEATING

CROSS REFERENCE TO OTHER APPLICATIONS

This application claims the benefit of U.S. Provisional application 62/613,033, filed Jan. 2, 2018, and U.S. application Ser. No. 16/238,224, filed Jan. 2, 2019 now U.S. Pat. No. 10,897,996.

FIELD OF THE INVENTION

The invention relates, in some embodiments and aspects, to "Ready-To-Assemble" furniture and methods of constructing and packaging the same. More specifically, in some embodiments and aspects, the invention relates to Ready-To-Assemble chairs, stools and other seating, and packaging and construction methods for the same.

BACKGROUND INFORMATION

Much of the furniture sold today is manufactured so it can be shipped as component parts, whether the components are wood, metal, plastic, combinations thereof, upholstered or non-upholstered. These component parts may be assembled by the manufacturer at a location distant from the factory and then sold to consumers, or the component parts can be packaged as a complete unit and sold directly to consumers whereby the consumer does the final assembly of the item. The latter is commonly referred to as Ready-To-Assemble (RTA) or "Knock Down" furniture.

A major advantage of RTA furniture over fully assembled or pre-assembled furniture is that the per-unit freight cost of RTA is made cheaper than assembled furniture by the simple fact that more units can be loaded into shipping trailers or containers than when fully or partially assembled. For this reason, manufacturers and retailers are constantly searching for ways to reduce the package size of such items. This also applies to warehousing costs, since the smaller RTA packaged items take up less storage space as the same unit fully assembled. If items can be manufactured and packaged to reduce their package size, there are significant cost savings in both the transportation and warehousing that can give the manufacturer and retailer a price advantage over their competitors.

With the growth of internet e-commerce sales, transportation costs become even more critical as e-commerce retailers compete with each other and brick and mortar retailers. When e-commerce retailers can reduce their dropship delivery costs on items from their distribution centers to their customers, they will have an overall increase in cost advantage. Because of this competitive environment, manufacturers and retailers are constantly attempting to reduce item package size in an effort to reduce their overall costs.

SUMMARY

Embodiments of the invention allow for the further reduction in the cubic measure of package sizes of RTA chairs, stools and seating than is currently possible using conventional manufacturing and packaging methods. Additionally, the smaller package size requires less warehouse space and less retail store display space, thereby reducing storage costs. Smaller packages that are easier to handle also reduce the risk of injury to individuals handling the items.

Aspects of the invention include methods of packaging Ready-To-Assemble chairs, stools and other seating. Other aspects include construction methods for the same.

Some embodiments of the invention may include a ready-to-assemble chair, comprising a seat assembly, wherein said seat assembly comprises a top seat surface, at least three sides, and an underside, wherein the underside has an internal cavity defined by the at least three sides; a seat back assembly, wherein said seat back assembly is configured to fit substantially within the internal cavity of the underside of the seat assembly in a flat orientation when said chair is disassembled; and at least three legs.

In further embodiments, an internal cavity of the seat assembly, the seat back assembly and at least one leg may be configured so that the seat back assembly and at least one leg can fit substantially within the internal cavity of the seat assembly in a flat orientation when said chair is disassembled. Yet further embodiments may include at least two legs fitting substantially within the internal cavity of the seat assembly in a flat orientation when said chair is disassembled.

In still further embodiments, the seat assembly may have a depression on the top seat surface, configured to accept the seat back assembly upon assembly of the chair: in some, said depression extends the entire width of said seat assembly, in others, said depression is configured such that one or more legs may be placed flat within said depression when said chair is disassembled.

In some embodiments, the width of the seat back assembly is the same as the width of the seat assembly, or wherein the width of the seat back assembly is smaller than the width of the seat assembly. In some embodiments, said seat assembly and/or seat back assembly may be upholstered. Some embodiments of the RTA chair further comprise seat covers for said seat assembly and/or seat back.

Some aspects of the invention may include a method of packaging a ready-to-assemble chair, wherein the ready-to-assemble chair comprises a seat assembly, wherein said seat assembly comprises a top seat surface, at least three sides, and an underside, wherein the underside has an internal cavity defined by the at least three sides, a seat back assembly, wherein said seat back assembly is configured to fit substantially within the internal cavity of the underside of the seat assembly in a flat orientation when said chair is disassembled, and at least three legs, comprising: placing the seat back assembly flat within the internal cavity of the underside of the seat assembly to minimize the overall dimensions of the chair when disassembled.

In some aspects the internal cavity of the seat assembly and the seat back assembly are configured, when said seat back assembly is placed within said internal cavity, to create a gap capable of fitting at least one leg, wherein the method further comprises placing said at least one leg flat within said gap.

Some aspects may further include the seat back assembly configured to have space to fit one or more legs either atop or below said seat back assembly, when said seat back assembly is placed within said internal cavity, further comprising placing said one or more legs flat either atop or below said seat back assembly.

In some aspects, the seat assembly has a depression on the top seat surface, configured to accept the seat back assembly upon assembly of the chair, further comprising placing one or more legs such that they lay flat within said depression. In some aspects, said depression extends the entire width of said seat assembly, in others, said depression is configured such that one or more legs may be placed flat within said depression when said chair is disassembled.

In some aspects, the width of the seat back assembly is the same as the width of the seat assembly, or wherein the width of the seat back assembly is smaller than the width of the seat assembly. In some aspects, said seat assembly and/or seat back assembly may be upholstered. Some embodiments of the RTA chair further comprise seat covers for said seat assembly and/or seat back.

Some aspects of the present invention may include a method of assembly of a ready-to-assemble chair, wherein the ready-to-assemble chair comprises, when said chair is disassembled, a seat assembly, wherein said seat assembly comprises a top seat surface, at least three sides, and an underside, wherein the underside has an internal cavity defined by the at least three sides, a seat back assembly, wherein said seat back assembly is configured to fit substantially within the internal cavity of the underside of the seat assembly in a flat orientation when said chair is disassembled, and at least three legs, comprising: attaching said seat back subassembly and said at least three legs to said seat assembly.

In some aspects, said chair further comprises, when said chair is disassembled, fasteners for attaching said seat back assembly to said seat assembly, and said at least three legs to said seat assembly, wherein said attaching said seat back subassembly and said at least three legs to said seat assembly, further comprises using said fasteners.

In some aspects, the internal cavity of the seat assembly, the seat back assembly and at least one leg is configured so that the seat back assembly and at least one leg fit substantially flat within the internal cavity of the seat assembly. In other aspects, at least two legs fit substantially flat within the internal cavity of the seat assembly. In others, said seat assembly has a depression on the top seat surface, configured to accept the seat back assembly upon assembly of the chair. In yet others, said depression extends the entire width of said seat assembly. In further aspects, said depression is configured such that one or more legs may be placed flat substantially within said depression, when the chair is disassembled.

In some aspects, the width of said seat back assembly is the same as the width of the seat assembly, in others the width of the seat back assembly is less than the width of the seat assembly. In others, said seat assembly and/or seat back assembly are upholstered. In yet others, said chair further comprises seat covers for said seat assembly and/or seat back, further comprising attaching said seat covers over said seat assembly and/or seat back.

BRIEF DESCRIPTION OF THE DRAWINGS

The attached drawings are included to further explain the embodiments and aspects of the present invention and constitute a part of this specification. The drawings illustrate embodiments and together with the description serve to explain principles of embodiments. Other embodiments and many of the intended advantages of embodiments will be readily appreciated as they become understood by reference to the following detailed description. The elements of the drawings are not to scale relative to each other. Like reference numbers designate corresponding similar parts.

FIG. 1 is an assembled view of a construction of an example embodiment of the invention.

FIG. 2 is an exploded view of a construction of an example embodiment of the invention.

DETAILED DESCRIPTION OF THE INVENTION

Figure 3:
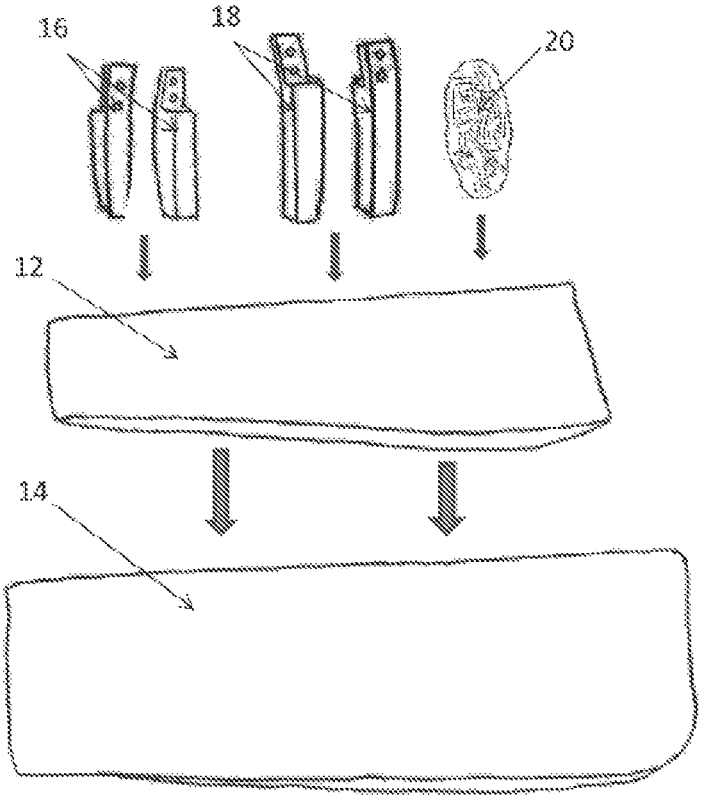
FIG. 3 is a drawing of the parts of an example embodiment of the invention illustrating the nesting feature of the invention.

Before any embodiments or aspects of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

The following discussion is presented to enable a person skilled in the art to make and use embodiments of the invention, and practice aspects of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

In general, terms used in the specification, drawing and claims shall be given their commonly used definition in the relevant arts. Where in conflict, the definitions provided below and elsewhere in the specification control. The "underside" of an object herein means its non-seating surface, not contacting a seated person in normal use. The directions "top" and "bottom" refer to the chair and chair parts oriented and assembled as in normal use (i.e., legs on the ground, chair upright). The terms "left" and "right" are equivalent to the left and right orientation of someone seated, facing forward, in the chair. For purposes of consistent description, the terms "length"/"height" and "width" are defined when parts or components are orientated as when assembled in a chair and the chair placed in a normal upright position. "Depth" is equivalent to the narrowest dimension of the seat or seat back assembly. Thus, for the seat back, the dimensions "height" "width" and "depth" are used; for the seat, "length" "width" and "depth" are used.

Two or more parts or components in a "flat" orientation or "fitting flat" against each other means that such parts are orientated near or against each other to minimize their overall depth, i.e., the volume they take up within a package; such parts may physically touch, but do not necessary need to, i.e., they may be separated by a protective layer or spacer during packaging in some embodiments or aspects.

In many embodiments and aspects of the invention, the seat back assembly may have a shape and height/length× width dimensions to fit within a cavity in the underside of the seat assembly, or vice versa. "To fit substantially within" is defined as having at least a part of the depth of the seat back assembly fit within the cavity in the underside of the seat (or vice versa). In other words, the depth of the seat back assembly (seat assembly) may be more, the same or less than the depth of the cavity in the underside of the seat assembly (seat back assembly), when fit substantially within and laying flat in the cavity.

An embodiment of the invention is directed to RTA seating, and manufacturing and packaging method for all types of seating. The invention is particularly suited to any seating where the parts can be manufactured in such a way that all parts nest within each other reducing the cubic measure of the unit when packaged.

An example embodiment of an assembled RTA chair, 10, is shown in FIG. 1, with seat back assembly 12, seat assembly 14, front legs 16, and back legs 18. In some embodiments, a seat, one or more front legs, one or more back legs, or combinations of the same, may be included. In some embodiments, a back may or may not be present.

In FIG. 2, an example embodiment of an exploded view of a disassembled RTA chair, showing the points of assembly. In embodiments where it is present, seat back assembly 12 may be fastened to seat assembly 14 by any suitable fastening means known in the art. One or more front legs 16, and one or more back legs 18 may be fastened to seat assembly 14 by any fastening means known in the art. In the embodiment shown in FIG. 2, for example, front legs 16 and back legs 18 are fastened to the seat assembly 14 underside inside (i.e., the underside seat cavity as discussed below), but they may be fastened to the outside, or inside and outside of seat 14 (for instance, back legs to the outside, front legs to the inside), in other embodiments.

Figure 4:
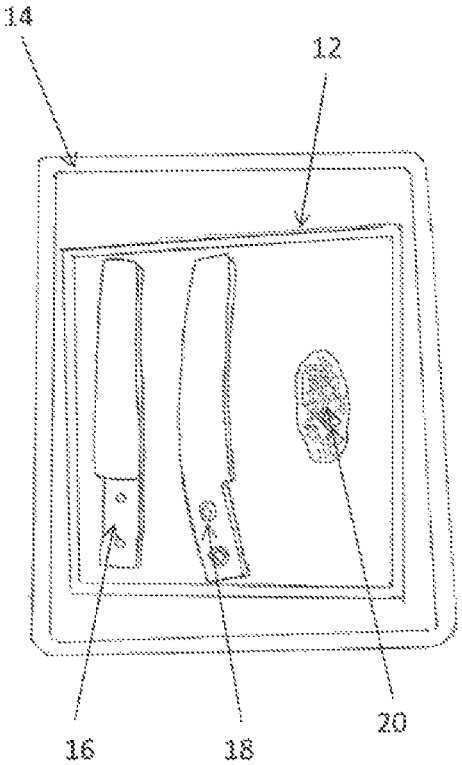
FIG. 4 is a view of the chair parts nested, in an example embodiment of the invention.

Referring to FIGS. 3 and 4, fastening hardware 20 may be included with the parts of the RTA seating in some embodiments. Fastening hardware may be any suitable fastening hardware, i.e., nuts and bolts, screws and washers, dowels, or any combination of the same, etc.

Referring to FIGS. 3 and 4, the RTA seating is sized, in some embodiments, such that when disassembled, the seat back assembly 12 is of such dimensions (i.e., width and length) that it fits within the underside of seat 14; alternatively, the seat assembly 14 may fit within the underside of seat back assembly 12. In some embodiments, the depth of the back assembly 12 is such that the back does not protrude over the top of the seat assembly when stacked flat within the seat 14. In some embodiments, the height/depth of the seat assembly 14 is such that the back does not protrude over the top of the seat when stacked within the seat back assembly 12. In some embodiments, the length and/or width of the seat back assembly 12 is such that it fits tightly within the seat assembly 14. In some embodiments, the length and/or width of the seat assembly 14 is such that it fits tightly within seat back assembly 12.

In some embodiments, the one or more front legs and one or more back legs 18 are manufactured in such a way that they are detachable from the assembled seating. In an example embodiment shown in FIGS. 3 and 4, the front legs 16, back legs 18 and assembly hardware 20 can be all together fit within back assembly 12 as it is nested within the underside of seat assembly 14. In other embodiments, one or more back legs, one or more front legs, and assembly hardware can be fit within back assembly 12, seat assembly 14 or both when packaged.

In the example embodiment shown in FIG. 4, with the front legs 16, back legs 18 and hardware 20 nested within the chair back assembly 12 and the chair back assembly 12 nested within the chair seat assembly 14, a reduced profile leading to smaller cubic packaging is achieved resulting in reduced transportation, storage, and handling costs.

Figure 5:
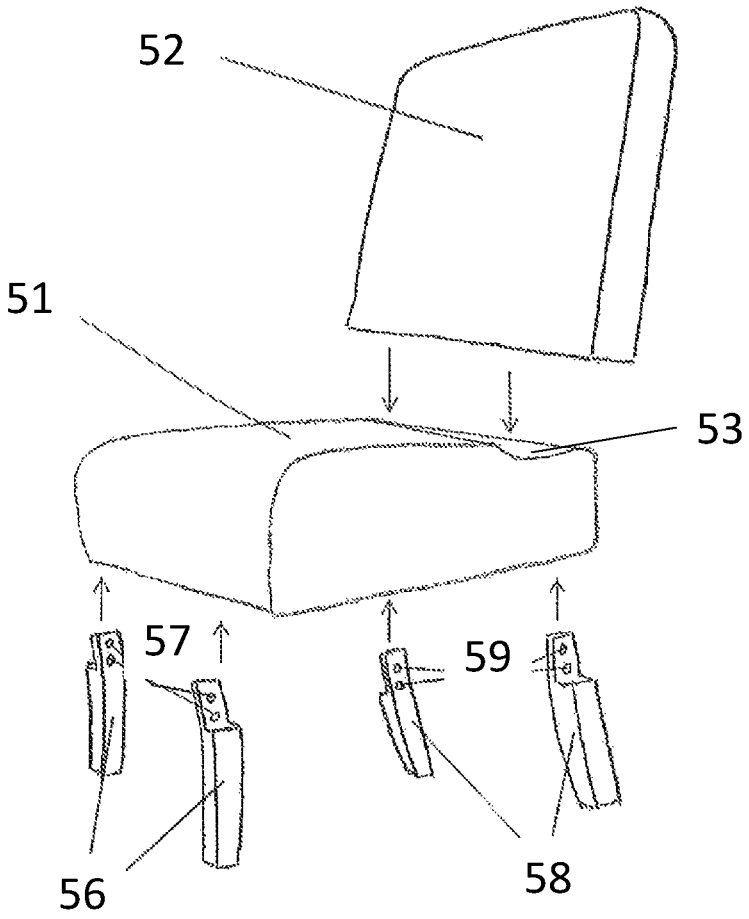
FIG. 5 is an exploded view of a construction of an example embodiment of the invention.

FIG. 5 is an exploded view of an example embodiment of the present invention. In this embodiment, seat back assembly 52 is attached to seat assembly 54 at depression 53 on the seat assembly, located at the rear of the top side of seat assembly 54. Back assembly 52 may be fastened to seat assembly 54 by any suitable fastening means known in the art. One or more front legs 56, and one or more back legs 58 may be fastened to seat assembly 54 by any fastening means known in the art. In this example embodiment one or more holes 57 are present in front legs 56, and one or more holes 59 are present in back legs 58 to allow the legs to be fastened to the seat assembly 54 by fasteners such as screws and bolts and/or other fasteners known in the art. In the embodiment shown in FIG. 5, for example, front legs 56 and back legs 58 are fastened to the inside/underside of seat 54, but they may be fastened to the outside, or inside and outside of seat 54 (for instance, back legs to the outside, front legs to the inside), in other embodiments.

Figure 6:
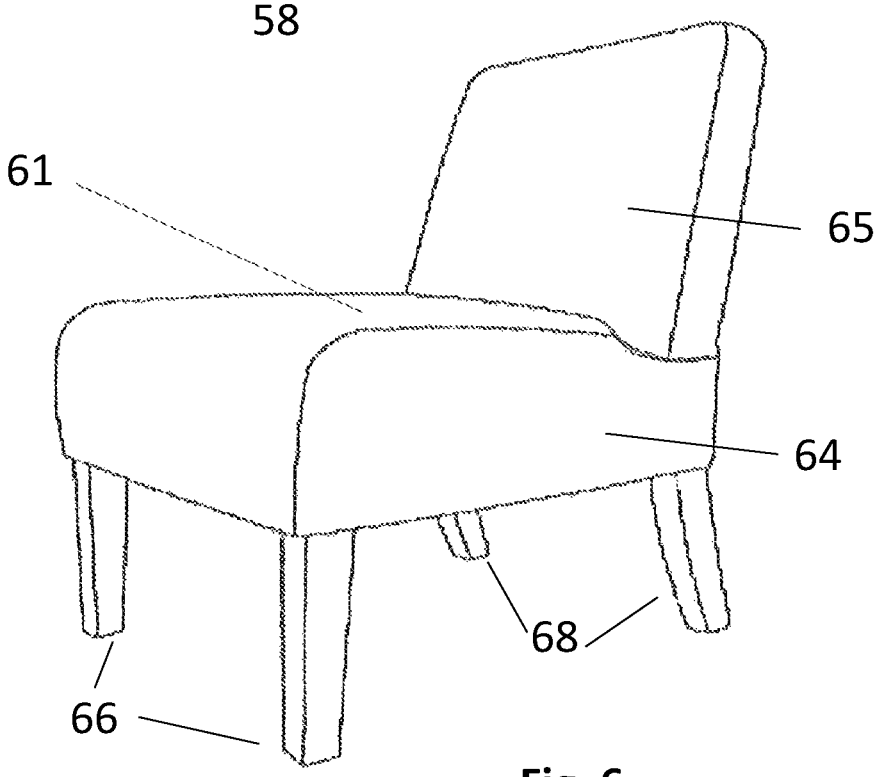
FIG. 6 is an assembled view of a construction of an example embodiment of the invention.

FIG. 6 shows an assembled version 50 of the example embodiment depicted in FIG. 5. Note that in some embodiments, the contour of depression 53 is visible on the outside of the chair at the junction of seat assembly 54 and seat back assembly 52.

Figure 7:
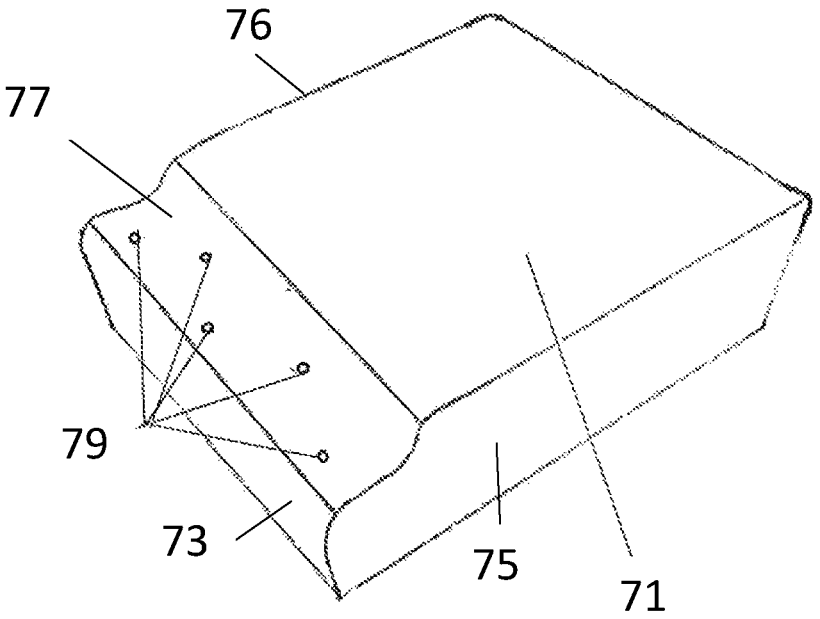
FIG. 7 is a perspective view of an example embodiment of a seat assembly of the present invention.

FIG. 7 is a perspective view of an example embodiment seat assembly showing top side 71, back side 73, and right lateral side 75. On the top side 71, adjacent to the backside 73 is a depression 77 that is designed to accept a seat back assembly in some embodiments. In some embodiments, depression 77 may extend the full width of the top side 71 (i.e., from right lateral side 75 to the opposing left lateral side 76). In other embodiments, depression 77 may not extend the full width of the top side 71. In such embodiments, depression 77 thus may not be visible from either the left side or the right side of the chair when assembled. In some embodiments, one or more holes 79 may be present in depression 77, and extend through to the underside of seat assembly 71 that can accept fasteners such as screws, bolts etc. to help assemble the seat back assembly (see e.g., FIG. 8) to the seat assembly 71.

Figure 8:
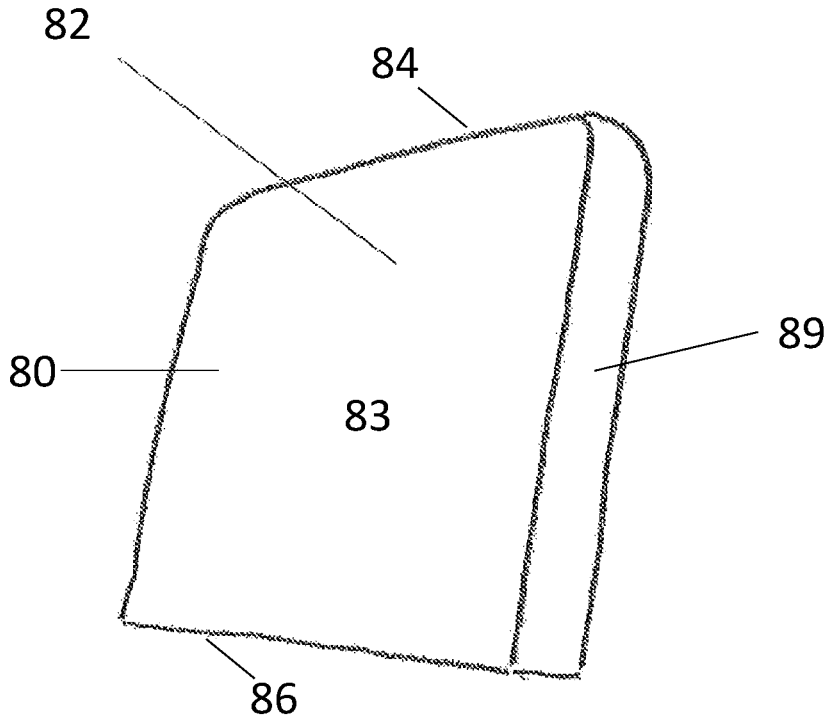
FIG. 8 is a view of an example embodiment of a seat back assembly of the present invention.

FIG. 8 depicts an example embodiment of a seat back assembly 82, with a front side 83, top side 84, bottom side 86, right side 88 (i.e. orientated in the direction of the seat assembly in FIG. 7) and left side 89. The lower part of the seat back assembly 82 may be shaped, for example to fit securely into depression 77, an example of which is depicted in FIG. 7.

Figure 9:
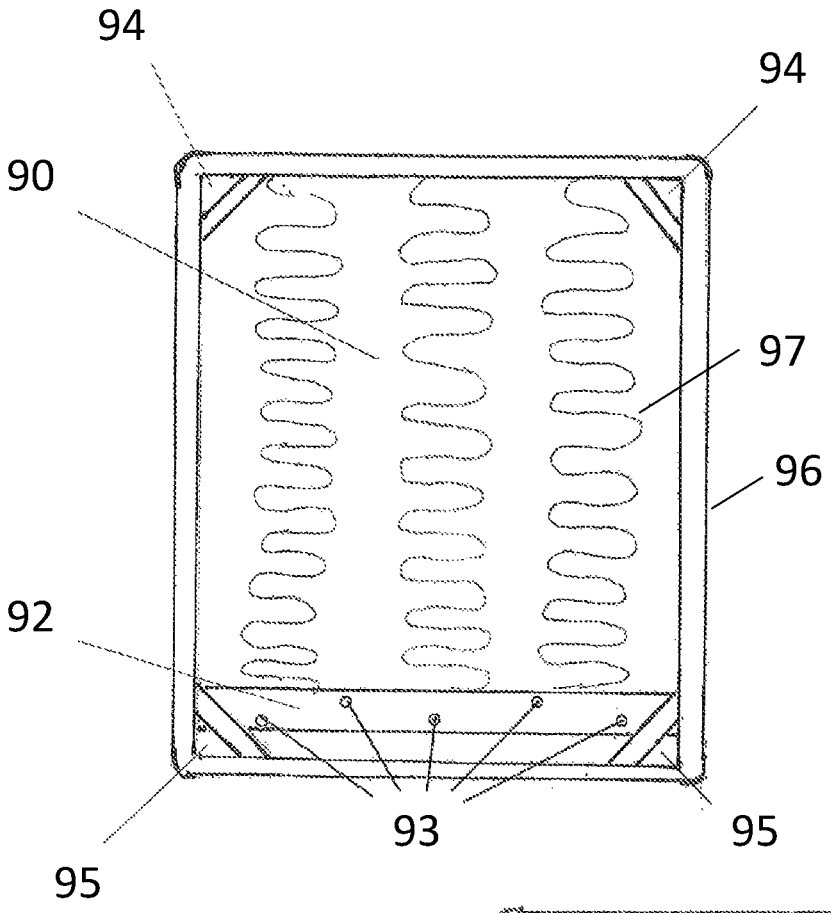
FIG. 9 is a bottom view of an example embodiment of a seat of the present invention.

FIG. 9 depicts an example embodiment of the underside of the seat assembly 90. In some embodiments, reinforcing strip 92 may be present, in, to allow a supporting surface for fasteners to attach seat back assembly to the seat assembly 90; said fasteners may extend through which one or more holes 93 that extend through the entire thickness of the seat assembly 90. Some embodiments may have reinforcing corners 94 for attachment of the front legs, and/or reinforcing corners 95 for attachment of the back legs, attached to frame 96 in some embodiments. As is known in the art, front and back legs may be shaped to allow firm attachment to said corners 94, 95. Reinforcing strip 92 and corners 94, 95 may be made of wood or other suitable materials. Another property of said strips and corners may be to give additional structural support to the seat assembly and RTA chair when assembled. In some embodiments, legs may be attached directly to frame 96. In some embodiments, said seat assembly may be upholstered and include cushioning material, which may be fashioned from any suitable cushioning material known in the art. Such cushioning material may be supported by metal spring supports 97 as shown in this example embodiment, straps or other such support as is known in the art, in some cases to allow additional "give" to the seat when in use.

Figure 10:
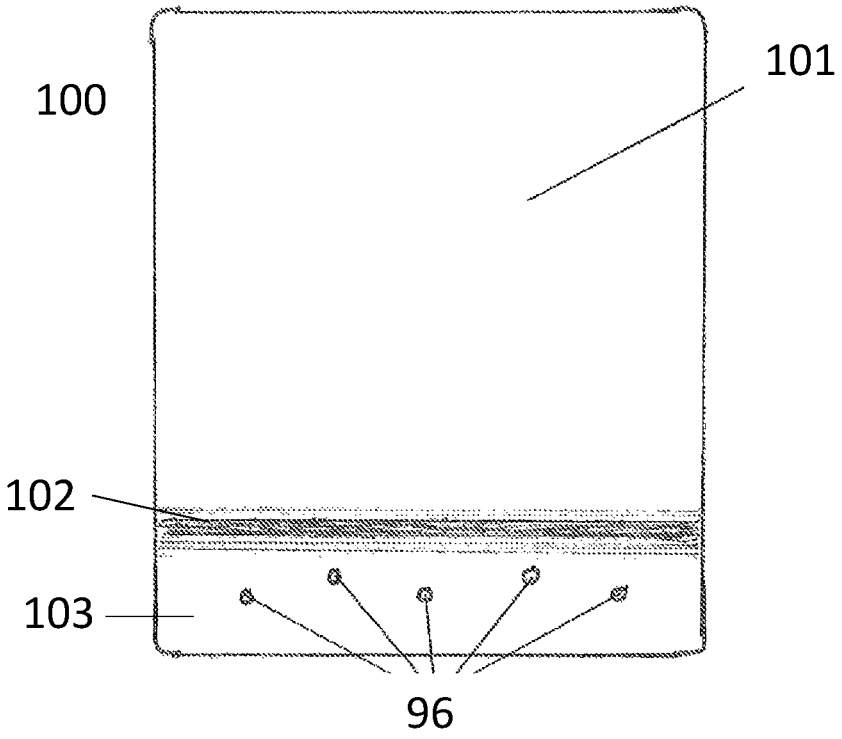
FIG. 10 is a top view of an example embodiment of a seat assembly of the present invention.

FIG. 10 shows the upper side of an example embodiment of seat assembly 100. In some embodiments, the seat surface is covered by a cushioning material 101. In some embodiments, there is a depression 103 to allow acceptance of a seat back assembly. In some embodiments the seat top slopes down at 102 from the seat top surface to the surface to the depression 103. In some embodiments, slope 102 is formed by a reinforced material, i.e., harder than the cushioning material 101 to retain its shape; in other embodiments, slope 102 is formed by a slope on the cushioning material itself. In many embodiments, there is no cushioning material at depression 103 to allow a tight attachment of seat assembly 100 to a seat back assembly.

Figure 11:
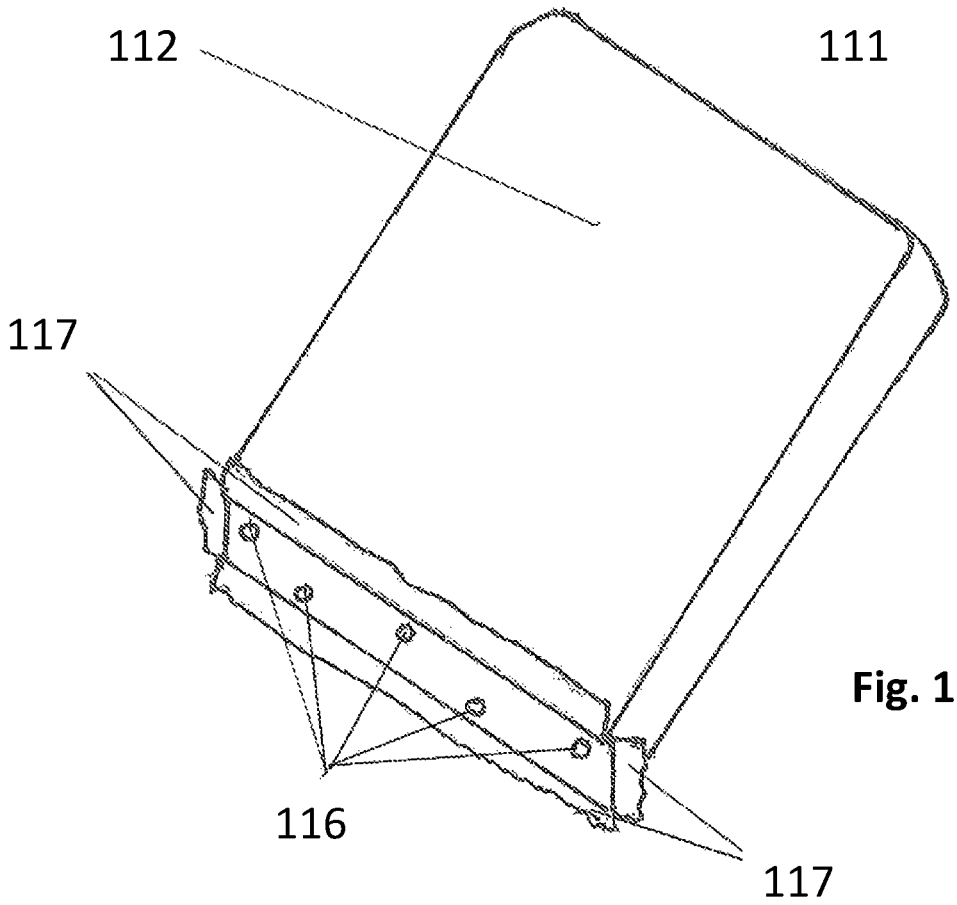
FIG. 11 is a is a perspective view of an example embodiment of a seat back assembly of the present invention

FIG. 11 shows a perspective view of an embodiment of a seat back assembly 110 which may be cushioned in some embodiments. The front 110 of the seat back may be substantially straight, as shown in FIG. 11 or concave in some embodiments. The bottom of the seat back assembly may have holes 116 designed to accept fasteners such as screws, bolts, and the like, to allow the seat back assembly to be attached to the seat assembly. In some embodiments, the seat back is covered by a removable seat back cover 112, which in some embodiments has cover flaps 117 that can be tucked against the bottom of the seat back assembly during or after fastening to a seat assembly to securely hold the removable seat back cover onto the seat back. In some embodiments, attachment means such as Velcro or snaps and the like may be attached to cover flaps 117 and the bottom of the seat back assembly to aid in securing the removable seat back cover 112.

Figure 12:
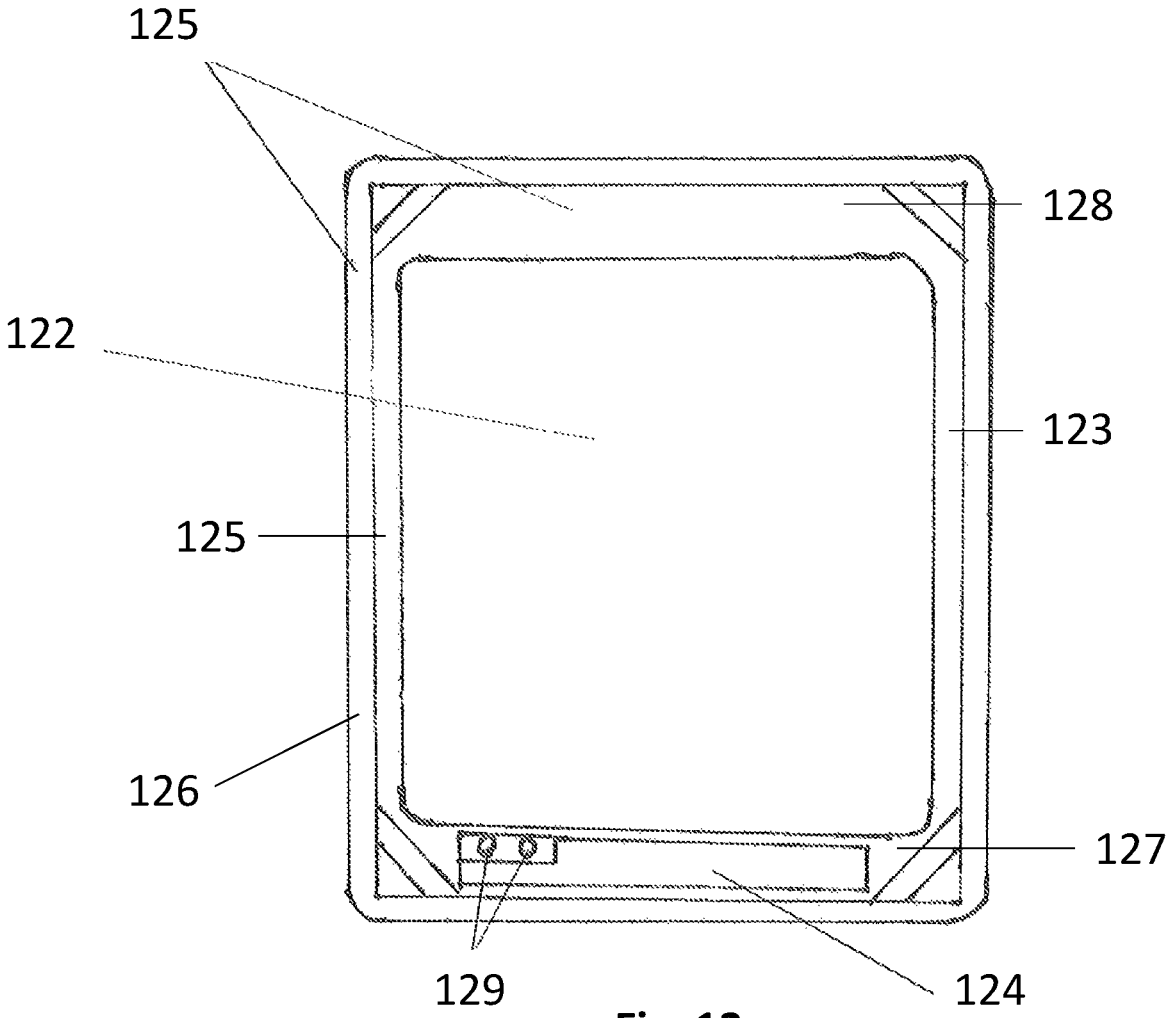
FIG. 12 is a view of the chair parts nested, in another example embodiment of the invention.

FIG. 12 shows an example embodiment of the seat assembly, seat back assembly and one or more legs in a nested orientation for packaging. Seat back assembly 122 may be nested within the underside of seat assembly 125. The orientation of the seat and seat back assemblies may create a wide gap 127, and in some embodiments, a wide gap 128 between the seat back assembly 122 and the frame 126 of the seat assembly large enough to accept one or more legs (e.g., 124). Narrow gaps 127 and 128 (gaps not capable of accepting a leg) are shown at opposite positions from each other, but one, three or four large gaps are possible in some embodiments, capable of accepting one or more legs. In some embodiments narrow gaps such as seen at 123 and 125 may be present, or in some embodiments, the seat back may fit snugly against the frame 126 of the assembly, such that essentially the width of gaps 123 and 125 is negligible/essentially zero.

In the example shown in FIG. 12, wider gaps (e.g. 127 and 128) are shown opposite each other, but in some embodiments, wider gaps may be adjacent to each other. In some embodiments, only one wide gap is present, two wide gaps are present, three wide gaps are present or four wide gaps are present.

Figure 16:
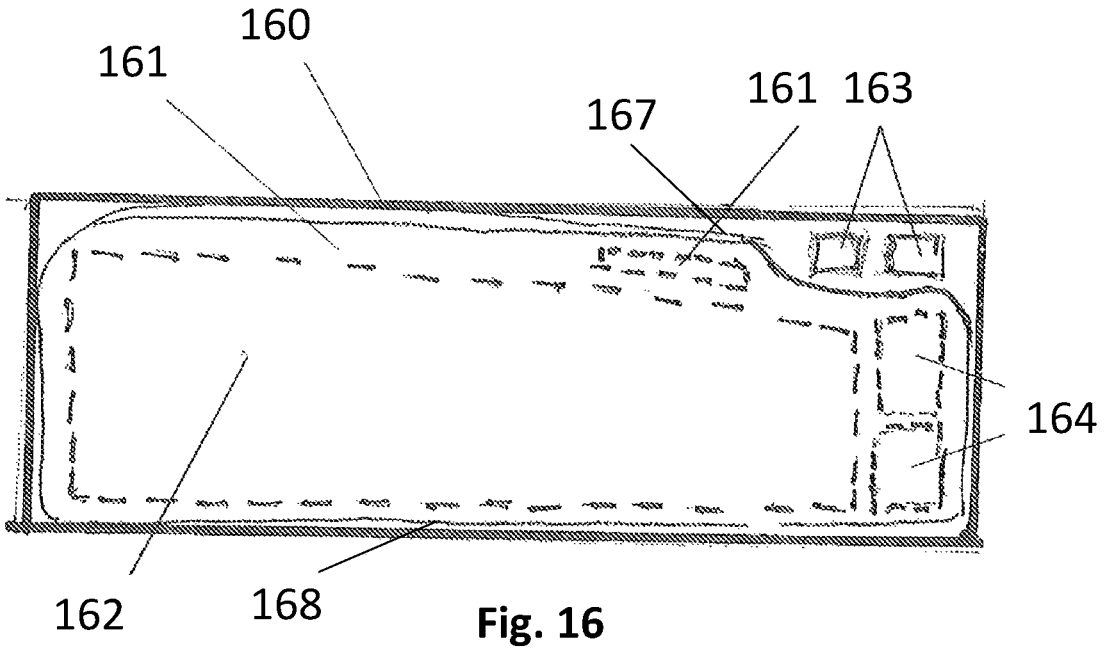
FIG. 16 is a side view of a packaged layout of an example embodiment of the invention.

Similarly, as noted above, leg 124 may be nested or placed between the nested seat 122 back and the frame 126 of the underside of seat assembly 122, in wide gap 127. Also shown are holes 129 on leg 124, which allow attachment of leg 124 to the seat assembly. In some embodiments, one or more legs may be placed in wide gap 127. In some embodiments, legs may be placed in wide gaps 127 and 128. In some embodiments, if more than one leg may be placed in a wide gap, they may be placed atop each other (e.g., as is shown in FIG. 16, described in more detail below).

Figure 13:
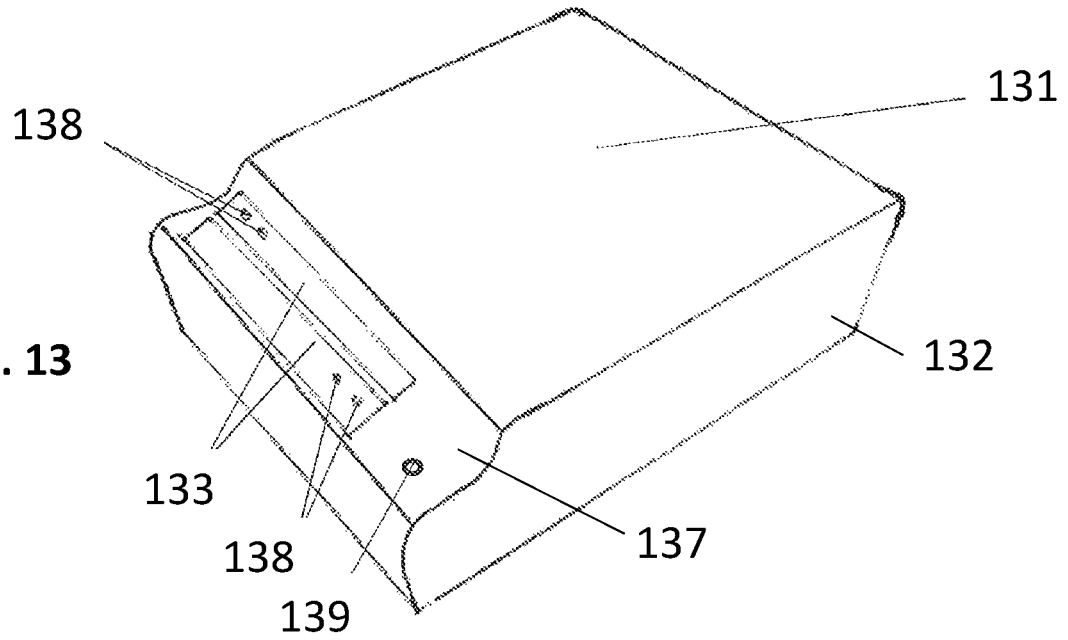
FIG. 13 is a view of the chair parts nested, in another example embodiment of the invention.

As noted above, legs may be placed in various orientations for various embodiments and aspects of the present invention. FIG. 13 shows an example embodiment where one, two or more legs 133 may be placed on the top side of seat assembly 131, in depression 137. Shown for illustration are leg attachment holes 138 and seat back assembly attachment hole 139. For purposes of packaging, legs may be placed within the underside of seat back assembly 131 and/or in the depression 137, or in another orientation, i.e., beside the seat assembly 131. In some embodiments, two legs are placed within the underside of seat back assembly and two legs placed in depression 137.

Figure 14:
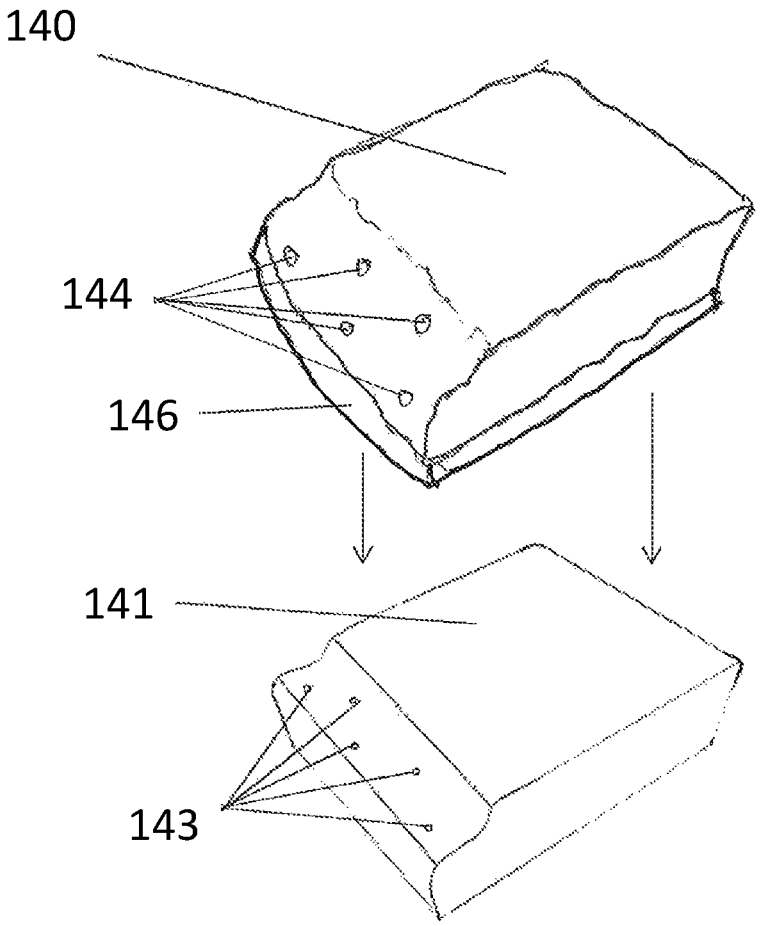
FIG. 14 is a view of an example embodiment of a removable seat cover for a seat assembly of an embodiment of the invention.

FIG. 14 shows an embodiment of a removable seat assembly cover of the present invention. In some embodiments, a removable seat cover 140 is designed to fit to the contours of the seat assembly 141. In some embodiments, holes 144 are placed in the seat cover that may be superimposable with the holes 143 when the seat cover is placed over the seat assembly in the correct orientation, to allow a seat back assembly to be attached to the seat assembly. Further embodiments may include cover flaps 146 that may be removably attached to the underside of seat 141 by attachment means such as Velcro, snaps and the like.

Figure 15:
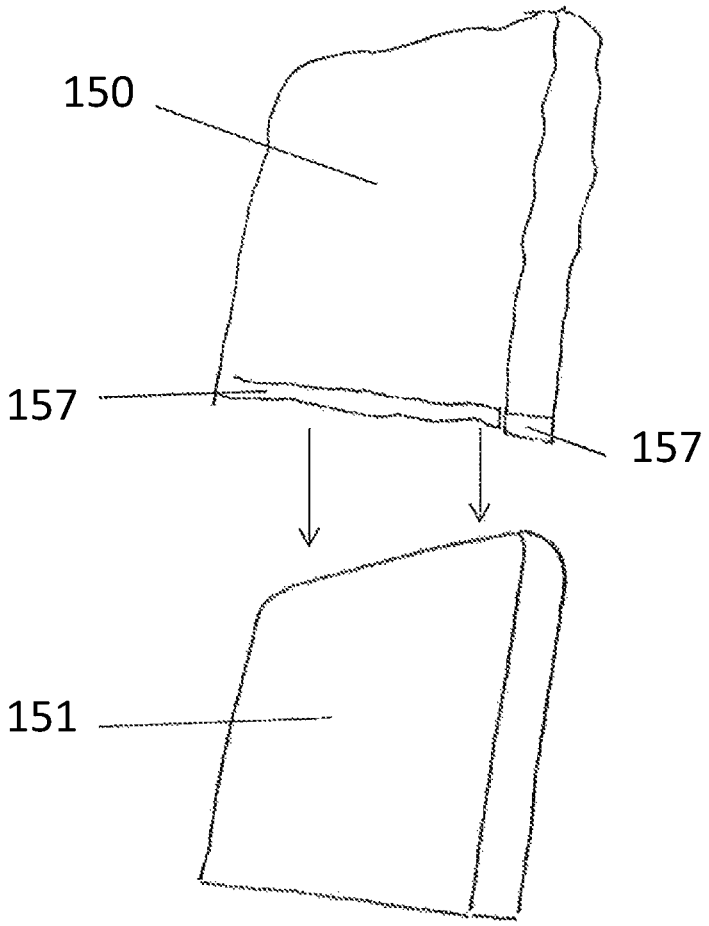
FIG. 15 is a view of an example embodiment of a removable seat back cover for a seat back assembly of an embodiment of the invention.

FIG. 15 shows an embodiment of a removable seat back assembly cover of the present invention. In some embodiments, a removable seat back cover 150 is designed to fit to the contours of the seat back assembly 151. Further embodiments may include cover flaps 156 that may be attached to the underside of seat 151.

A side view of an example packaging embodiment is shown in FIG. 16. The seat back and seat assemblies are configured to allow for a minimal box size. A box with top 160 and bottom 168 contains a seat assembly 161 and two legs 163 (either front or back legs or a combination thereof) placed, in some embodiments, atop the seat assembly within the space allowed by depression 167. Seat back assembly 162 is nested within the underside of seat assembly 161, shown with dotted lines. The remaining two legs 164 may be nested within the seat assembly, placed in a space between the underside surface of the seat assembly 161 and the seat back assembly 162. In addition, in some embodiments, a bag 169 containing fasteners, instruction for assembly and the like may also be nested in the underside of seat assembly 161.

Embodiments of the present invention are RTA chairs, which may be upholstered chairs (i.e., containing cushioning, stuffing etc.) in some embodiments, configured to be efficiently packageable. While typical dining chairs are provided in the example embodiments shown here, persons of skill in the art would realize that embodiments and aspects of the invention also encompass other types of chairs, such as, but not limited to, backless chairs such as stools, backed chairs such as accent chairs, including club chairs, wingback chairs, Bergere chairs, Lawson chairs, barrel chairs, English rolled arm chairs, slipper chairs, ottoman/lounge chairs, chesterfield chairs; arm chairs; recliners; round chairs; love seats; dining chairs, bar stools, wishbone chairs, ghost chair, side chairs; office chairs, reading chairs, desk chairs; outdoor chairs; folding chairs; chaise lounge chairs; wicker chairs; rocking chair; glider chair and the like. See, e.g., https://www.homestratosphere.com/types-of-chairs/ for examples of types of chairs known in the art as maybe practices with this invention.

In the present invention, the topside of the seat assembly may be comprised of any material known in the art as a suitable chair surface, e.g., wood, metal, fabric or a combination of the same, and may or may not be cushioned. The seat assembly may or may not be configured to incorporate or accept a removable seat cover, that allows the covering to be laundered or replaced as needed.

The length and width of the seat assembly may be any length and width suitable for a chair. In many embodiments, the usable seating surface will be smaller than the topside surface of the seat assembly, as a portion of the seat assembly is used as the site of attachment for the seat back assembly. The depth of the seat assembly may be any suitable depth, forming four sides of the seat assembly. The sides of the seat back assembly may have the same or varying heights.

The underside of the seat assembly in some embodiments is configured to create an internal cavity. The internal cavity is formed by the sides of the seat assembly and is configured in shape and size to accept the seat back assembly when disassembled. In some embodiments, the shape and size of the cavity is configured to accept the seat back assembly and one or more legs when disassembled. In some embodiments, the shape and size of the hollow is configured to accept the seat back assembly, one or more legs, and one or more fasteners, printed assembly instruction as the like when disassembled.

In the present invention, the seat back assembly may be comprised of any material known in the art as a suitable chair surface, e.g., wood, metal, fabric or a combination of the same, and may or may not be cushioned. In some embodiments the cushioning is limited to the front of the chair back surface. The seat back assembly may or may not be configured to incorporate or accept a removable seat cover, that allows the covering to be laundered or replaced as needed.

The seat back assembly in embodiments of the present invention may have any length and width suitable for a chair. In order to nest within the underside of the seat assembly, the outer dimensions of the seat back assembly, however, must be smaller than the diameter of the internal cavity in the underside seat assembly.

In some embodiments, the seat assembly, and thus the length of the internal cavity of the seat assembly is just shorter, exactly or longer than the width of the seat back assembly when assembled, allowing a chair with a seat back with a width, just shorter, the same as, or wider than the seat assembly when assembled. In other words, the width of the seat back assembly can fit inside the length of the internal cavity of the seat assembly. In some embodiments, the width of the seat back assembly is such that it fits tightly within the internal cavity of the seat back, allowing less additional packaging (such as cardboard, etc.) to protect the packaged invention during shipment and storage. In some of the above embodiments, the width and/or height of the seat back assembly is less than the width of the internal cavity of the seat assembly, allowing one or more legs, instructions, fasteners, and the like to be placed within the internal cavity of the seat assembly during packaging.

In some embodiments, the seat assembly, and thus the length of the internal cavity of the seat assembly is just shorter, exactly or longer than the height of the seat back assembly when assembled, allowing a chair with a seat back with a greater height than the previously described embodiments; the width of the seat back assembly will be narrower than the width of the seat assembly, i.e., equal to or shorter to the width of the internal cavity of the seat assembly. In some embodiments, the height of the seat back assembly is such that it fits tightly within the internal cavity of the seat back, allowing less additional packaging (such as cardboard, etc.) to protect the packaged invention during shipment and storage. In some of the above embodiments, the width and/or height of the seat back assembly is less than the width of the internal cavity of the seat assembly, allowing one or more legs, instructions, fasteners, and the like to be placed within the internal cavity of the seat assembly during packaging.

In general, the internal cavity of the seat assembly has a certain depth. The depth of the internal cavity may be less, equal to, or more than the depth of the seat back assembly, such that the seat assembly may sit flat and fit substantially within the cavity. The seat back assembly may have a straight, concave, convex or otherwise curved shape—the depth is thus defined as the maximum height of the seat back assembly if placed on a flat surface.

In some embodiments, the seat back assembly and seat assembly may be configured to leave a large gap such that one or more legs may to be able to be placed besides the seat back subassembly when fit flat within the internal cavity of the seat back assembly. In some embodiments, the seat back assembly may be configured such that it has sufficient curvature or less depth relative to the internal cavity of the seat assembly that one or more legs may be placed underneath and/or on top of the seat back assembly when the RTA is packaged. In some embodiments, the seat assembly and legs may be configured such that one or more legs may be placed within a depression on the seat top side of the seat assembly. In some embodiments, legs may be placed in one or more of the locations described in this paragraph when packaged.

Aspects of the present invention includes assembly of chairs of the present invention. Other aspects include packaging of chairs of the present invention in order to minimize packaging size. In aspects of the methods of the present invention, legs, seat assembly, seat back assembly and may be placed and orientated in any of the ways described above to minimize packaging size. The orientation may be secured, and the chair parts and components protected by boxes, plastic bagging, shrink wrap and the like during storage and transport. Additional packaging material such as paper, foam may be included to protect the chair components, although the present invention may minimize the need for such materials compared to other RTA chairs known in the art.

What is claimed is:

1. A method of packaging a ready-to-assemble chair, wherein the ready-to-assemble chair comprises a seat assembly, wherein said seat assembly comprises a top seat surface, at least three sides, and an underside, wherein the underside has an internal cavity defined by the at least three sides, a seat back assembly, wherein said seat back assembly is configured to fit substantially within the internal cavity of the underside of the seat assembly in a flat orientation when said chair is disassembled, and wherein said seat assembly has a depression on the top seat surface, configured to accept the seat back assembly upon assembly of the chair, and at least three legs, and wherein said seat assembly and seat back assembly have holes for accepting fasteners to fasten the seat back assembly to the seat assembly, and wherein the seat back assembly is configured such that the width of the seat back assembly is the same as the width of the seat assembly when assembled, comprising:

placing the seat back assembly flat within the internal cavity of the underside of the seat assembly to minimize the overall dimensions of the chair when disassembled.

2. The method of claim 1, wherein the internal cavity of the seat assembly and the seat back assembly are configured, so that the seat back assembly and at least one leg can fit substantially within the internal cavity of the seat assembly in a flat orientation when said chair is disassembled, further comprising placing said at least one leg flat within said internal cavity of the seat assembly in a flat orientation when said chair is disassembled.

3. The method of claim 1, wherein the internal cavity of the seat assembly, the seat back assembly and at least two legs are configured so that the seat back assembly and at least two legs can fit substantially within the internal cavity of the seat assembly in a flat orientation when said chair is disassembled, further comprising placing said at least two legs flat within said internal cavity of the seat assembly in a flat orientation when said chair is disassembled.

4. The method of claim 1, wherein said depression extends the entire width of said seat assembly, further comprising placing one or more legs such that they lay flat within said depression.

5. The method of claim 1, wherein said seat assembly and/or seat back assembly of said ready-to-assemble chair are upholstered.

6. The method of claim 1, wherein said ready-to-assemble chair further comprises seat covers for said seat assembly and/or seat back.

7. A method of assembly of a ready-to-assemble chair, wherein the ready-to-assemble chair comprises, when said chair is disassembled, a seat assembly, wherein said seat assembly comprises a top seat surface, at least three sides, and an underside, wherein the underside has an internal cavity defined by the at least three sides, a seat back assembly, wherein said seat back assembly is configured to fit substantially within the internal cavity of the underside of the seat assembly in a flat orientation when said chair is disassembled, and and wherein said seat assembly has a depression on the top seat surface, configured to accept the seat back assembly upon assembly of the chair; and at least three legs, and wherein said seat assembly and seat back assembly have holes for accepting fasteners to fasten the seat back assembly to the seat assembly, and wherein the seat back assembly is configured such that the width of the seat back assembly is the same as the width of the seat assembly when assembled, comprising:

attaching said seat back subassembly and said at least three legs to said seat assembly.

8. The method of claim 7, wherein said chair further comprises, when said chair is disassembled, fasteners for attaching said seat back assembly to said seat assembly, and said at least three legs to said seat assembly, wherein said attaching said seat back subassembly and said at least three legs to said seat assembly, further comprises using said fasteners.

9. The method of claim 7, wherein the internal cavity of the seat assembly, the seat back assembly and at least one leg of said ready to assemble chair are configured so that the seat back assembly and at least one leg fit substantially within the internal cavity of the seat assembly in a flat orientation when said chair is disassembled.

10. The method of claim 7, wherein the internal cavity of the seat assembly, the seat back assembly and at least two legs of said ready to assemble chair are configured so that the seat back assembly and at least two legs can fit substantially within the internal cavity of the seat assembly in a flat orientation when said chair is disassembled.

11. The method of claim 7, wherein said depression extends the entire width of said seat assembly, wherein said depression is configured such that one or more legs may be placed flat substantially within said depression, when the chair is disassembled.

12. The method of claim 7, wherein said seat assembly and/or seat back assembly are upholstered.

13. The method of claim 7, wherein said chair further comprises seat covers for said seat assembly and/or seat back, further comprising attaching said seat covers over said seat assembly and/or seat back.

14. A method of assembly of a ready-to-assemble chair, wherein said ready-to-assemble chair comprises, when said chair is disassembled:

a seat assembly, wherein said seat assembly comprises a top seat surface, at least three sides, and an underside, wherein the underside has an internal cavity defined by the at least three sides;

a seat back assembly, wherein said seat back assembly is configured to fit substantially within the internal cavity of the underside of the seat assembly in a flat orientation when said chair is disassembled, and wherein said seat assembly has a depression on the top seat surface, configured to accept the seat back assembly upon assembly of the chair; and at least three legs, and wherein said depression is configured such that one or more legs may be placed in a flat orientation entirely within said depression when said chair is disassembled comprising:

attaching said seat back subassembly and said at least three legs to said seat assembly.

* * * * *